US005477773A

United States Patent [19]

Murakami et al.

[11] Patent Number: 5,477,773

[45] Date of Patent: Dec. 26, 1995

[54] WAVE PLATE TYPE COMPRESSOR

[75] Inventors: Kazuo Murakami; Masahiro Kawaguchi; Kunifumi Goto, all of Kariya, Japan

[73] Assignee: Kabushiki Kaisha Toyoda Jidoshokki Seisakusho, Kariya, Japan

[21] Appl. No.: 255,188

[22] Filed: Jun. 7, 1994

[30] Foreign Application Priority Data

Jun. 8, 1993 [JP] Japan ..... 5-137832

[51] Int. Cl.[6] ..... F01B 3/00

[52] U.S. Cl. ..... 92/71; 92/138; 417/269; 74/60

[58] Field of Search ..... 92/12.2, 71, 138; 417/269; 74/60

[56] References Cited

U.S. PATENT DOCUMENTS

| | | | |
|---|---|---|---|
| 2,176,300 | 10/1939 | Fette . | |
| 2,374,595 | 4/1945 | Franz | 74/60 |
| 4,640,144 | 2/1987 | McLendon | 92/71 |
| 4,756,239 | 7/1988 | Hattori et al. | 92/71 |

FOREIGN PATENT DOCUMENTS

| | | | |
|---|---|---|---|
| 57-110783 | 7/1982 | Japan . | |
| 62-121875 | 6/1987 | Japan . | |
| 62-121874 | 6/1987 | Japan . | |
| 63-147571 | 9/1988 | Japan . | |
| 4179873 | 6/1992 | Japan | 417/269 |

OTHER PUBLICATIONS

European Search Report for European Patent Application No. 94 10 8724.9.

*Primary Examiner*—Thomas E. Denion

*Attorney, Agent, or Firm*—Brooks Haidt Haffner & Delahunty

[57] ABSTRACT

Disclosed is a compressor having a plate rotatable about an axis of a rotary shaft and a piston connected to the plate. The plate causes the piston to reciprocate between a top dead center and a bottom dead center of its stroke in accordance with the rotation movement of the plate. Cam surfaces are provided on the plate for actuating the piston. The cam surfaces have first portions for driving the piston toward the top dead center, and second portions for driving the piston toward the bottom dead center. Transmission members are interposed between the piston and the cam surface for transmitting the rotational movement of the plate to the piston. The first and second portions cause the transmission members to follow on the cam surfaces. At lease one of the first and second portions are arranged to have a normal line extending obliquely to the axis of the rotary shaft for constant contact between the transmission members and the one of the portions.

16 Claims, 12 Drawing Sheets

WAVE PLATE TYPE COMPRESSOR

BACKGROUND OF THE INVENTION

1. Field of the Invention

The present invention relates to a wave plate type compressor in which a piston reciprocates in response to the rotation of a wave plate secured to a rotary shaft.

2. Description of the Related Art

In a conventional swash plate type compressor, one head of a double-headed piston completes a single compression cycle for every rotation made by the swash plate and the rotary shaft. On the other hand, with compressors using a wave plate, one head of the double-headed piston completes a plurality of compression cycles in accordance with the shapes of the cam surfaces or cam grooves on the wave plate for each rotation of the rotary shaft. The wave plate type compressors therefore have an advantage over the swash plate type compressor in that the discharge displacement per rotation is increased.

Conventional wave plate type compressors are disclosed in Japanese Unexamined Patent Publication No. 57-110783 and Japanese Unexamined Utility Model Publication No. 63-147571. In the compressor described in the Japanese Unexamined Patent Publication No. 57-110783, in particular, rollers 53 and 54 are provided between an associated double-headed piston 52 and the front and rear cam surfaces 51*a* and 51*b* of a wave plate 51 as shown in FIG. 13. The rollers 53 and 54 are rotatably fitted in the piston 52, and are capable of rolling on the wave plate 51. As the wave plate 51 rotates, its cam surfaces 51*a* and 51*b* engage and displace the rollers 53 and 54. These rollers then transmit this displacement to the piston 52, in turn, causing its reciprocation.

In the compressor described in the Japanese Unexamined Utility Model Publication No. 63-147571, cam grooves are formed on the front and rear surfaces of the wave plate instead of the cam surfaces. In this publication, balls rather than rollers are interposed between the cam groove and double-headed piston.

Although the rollers or balls may at first appear to be in line contact with the wave plate, a microscopic view reveals a plane contact exists between the contacting components due to their deformation under pressure. This deformation results in the occurrence of the so called "Hertz" contact which effectively increases the contact area shared between the rollers or balls and the wave plate.

To improve the durability of the compressor, it is important to reduce the contact pressure between the above contacting components. This can be done by increasing the length of the line contact or reducing the curvature of the contact portion (i.e., by increasing the radius of curvature). It is apparent, on a microscopic level, that a reduction in the curvature of the contact portion causes an increase in the contact area, and thus reduces the overall contact pressure.

Contact pressure can thus be reduced by increasing the contact area between the wave plate and either the length or diameter of the rollers or the diameter of the balls. Increases made to the length or diameter of the rollers and balls, however, are limited by the diameter of the piston, since each roller or ball is fitted to its associated piston. Such increases tend to increase the size of the piston as well as the compressor. Given the trend toward increasingly compact compressors, increases to the size of the compressor are distinctly disadvantageous.

SUMMARY OF THE INVENTION

It is therefore an object of the present invention to provide a wave plate type compressor whose durability can be improved without enlarging the compressor.

To achieve the above object, according to a wave plate type compressor embodying this invention, the compressor has a plate rotatable about an axis of a rotary shaft and a piston connected to the plate. The plate causes the piston to reciprocate between a tope dead center and a bottom dead center of its stroke in accordance with the rotational movement of the plate. Cam means is provided on the plate for actuating the piston. The cam means has first portions for driving the piston toward the top dead center, and second portions for driving the piston toward the bottom dead center. Transmission means is interposed between the piston and the plate for transmitting the rotation movement of the plate to the piston. The first and second portions cause the transmission means to follow on the cam means. At lease one of the first and second portions are arranged to have a normal line extending obliquely to the axis of the rotary shaft for a constant contact between the transmission means and the one of the portions.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with the accompanying drawings in which;

FIG. 11(*b*) is a perspective view of a shoe according to this modification;

DETAILED DESCRIPTION OF THE PREFERRED EMBODIMENTS

Figure 1:
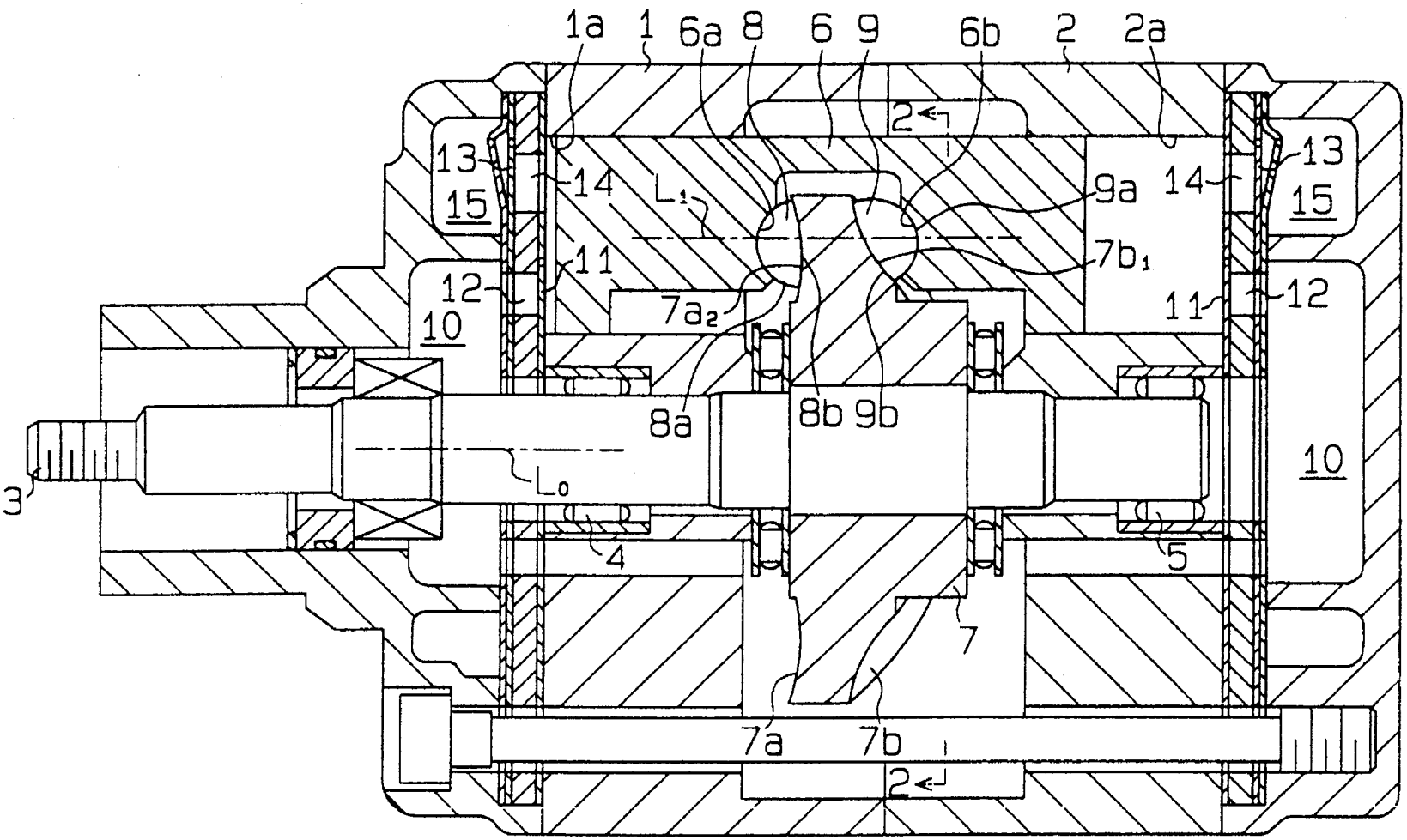
FIG. 1 is a cross-sectional side view of an entire compressor embodying the present invention.
Figure 2:
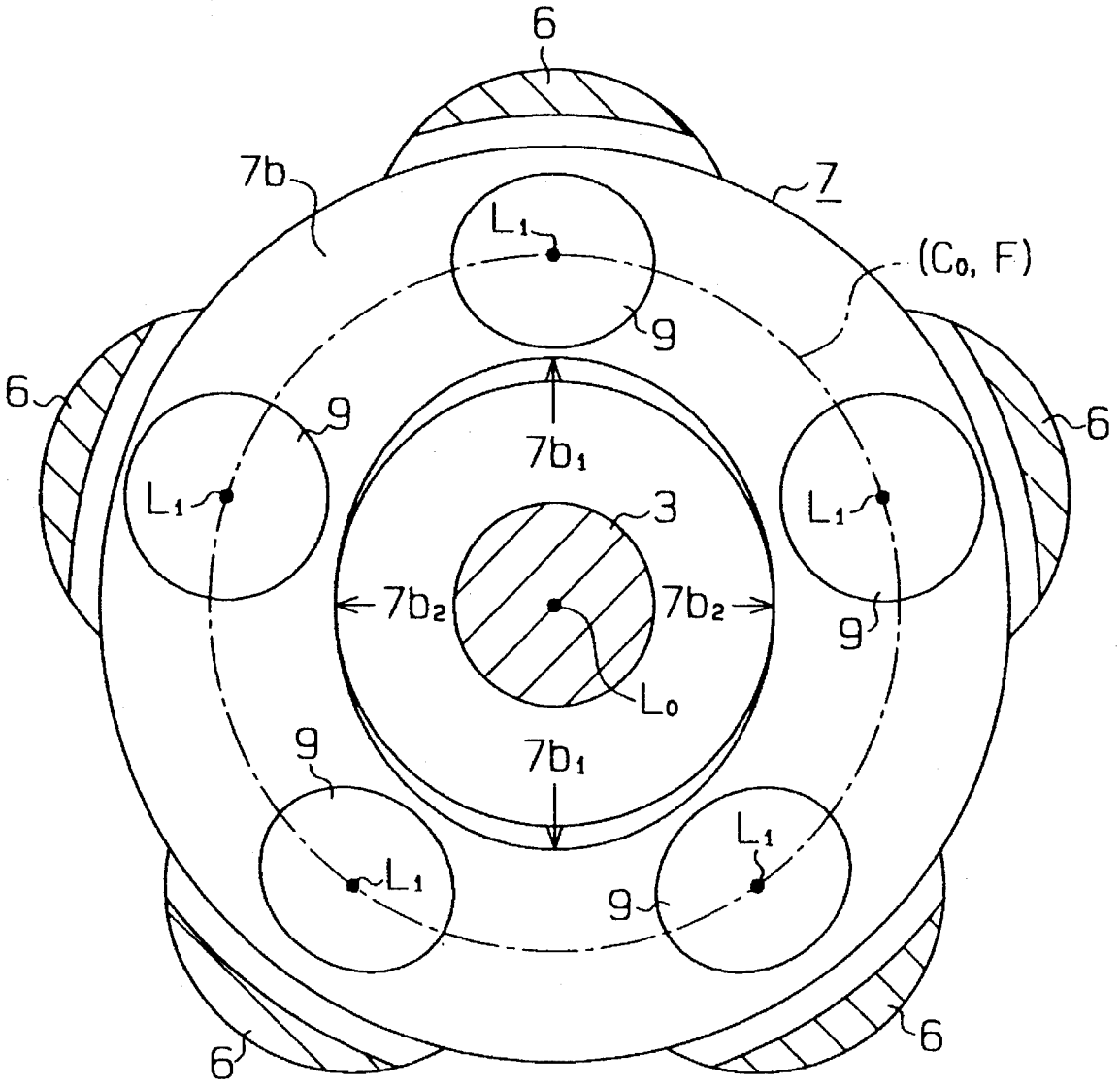
FIG. 2 is a cross section taken along the line 2—2 in FIG. 1.

One embodiment of the present invention will now be described referring to FIGS. 1 through 4. As shown in FIG. 1, a rotary shaft 3 is rotatably supported via bearings 4 and 5 in a pair of cylinder blocks 1 and 2 which are secured to each other. A plurality of bores 1*a* and 2*a* (five each in this embodiment) are respectively formed in the cylinder blocks 1 and 2 at equiangular distances on a plurality of axes $L_1$ located on an imaginary circumferential plane $C_0$ around the axis, L0, of the rotary shaft 3. Each bore 1*a* in the front cylinder block 1 is paired with the associated bore 2*a* in the cylinder block 2, thereby forming a plurality of cylinder bores. As shown in FIG. 2, a plurality of double-headed pistons 6 are reciprocally retained in the respective bores 1*a* and 2*a*.

Figure 3:
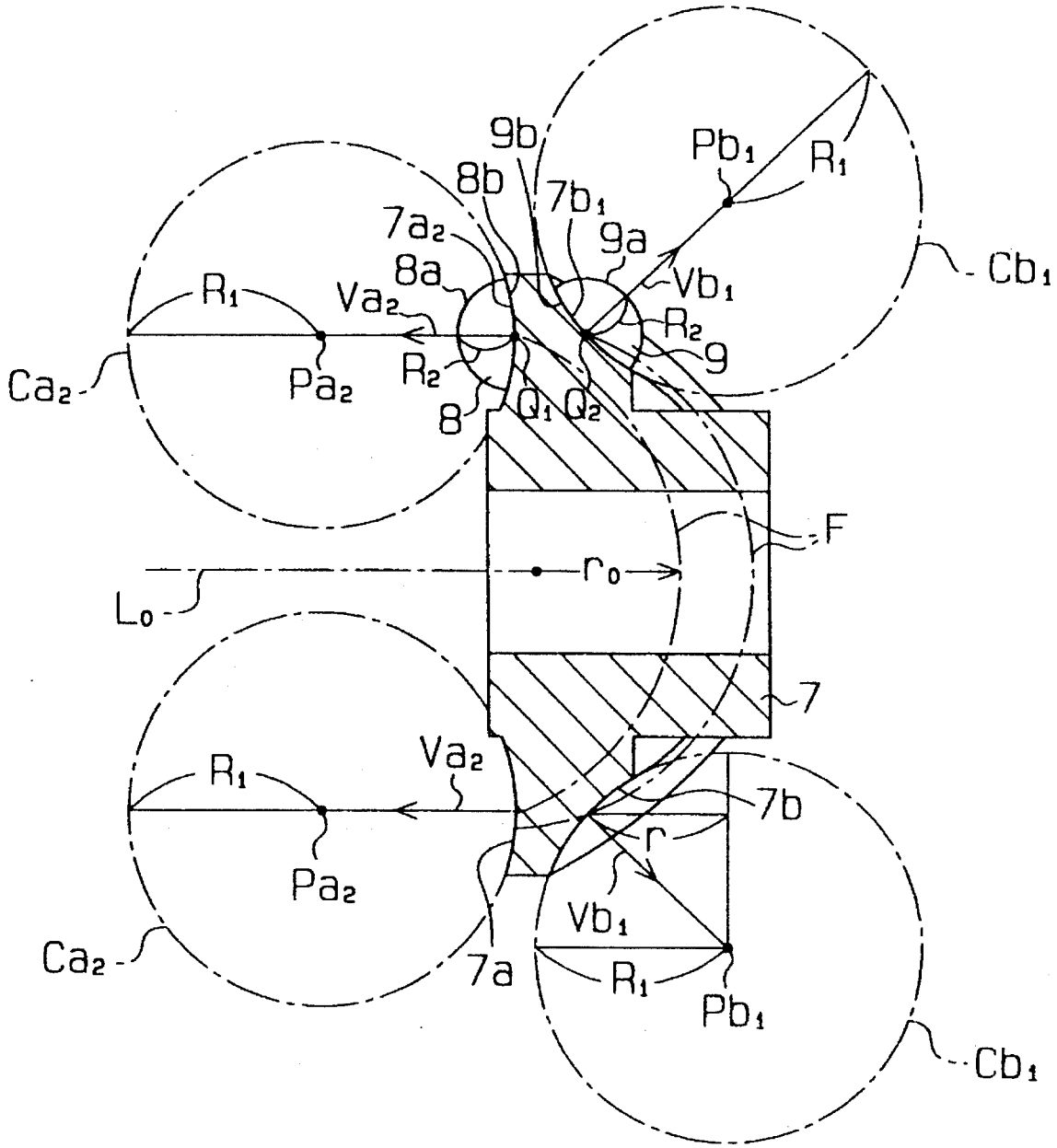
FIG. 3 is a cross section of a wave plate in the compressor shown in FIG. 1.

A wave plate 7, secured to the rotary shaft 3, has can surfaces 7*a* and 7*b* formed with a predetermined width at the front and rear portions of the wave plate 7. A pair of shoes 8 and 9 are provided between the wave plate 7 and each piston 6. The piston 6 has a pair of recesses 6*a* and 6*b* at the center. The shoes 8 and 9 have first spherical surfaces 8*a* and 9*a*, which are fitted in the respective recesses 6*a* and 6*b*, and second spherical surfaces 8*b* and 9*b*, which slide on the respective cam surfaces 7*a* and 7*b* of the wave plate 7. As shown in FIG. 3, the radius of curvature $R_1$ of the second spherical surfaces 8*b* and 9*b* is larger than the radius of curvature $R_2$ of the first spherical surfaces 8*a* and 9*a*. The centers, $Q_1$ and $Q_2$, of the first spherical surfaces 8*a* and 9*a* are located substantially at the centers of the second spherical surfaces 8*b* and 9*b*.

The cam surfaces 7*a* and 7*b* of the wave plate 7 are located on a displacement curve F on the circumferential surface $C_0$. The displacement curve F is a 2-cycle displacement curve which has four first portions alternately protruding forward and rearward (leftward and rightward in FIG. 1) with respect to a plane perpendicular to the axis $L_0$ of the rotary shaft 3. In addition, second portions are provided that link the four first portions. Examples of the displacement curve F of the cam surfaces 7*a* and 7*b* include a sinusoidal displacement curve and a cycloidal displacement curve.

For each revolution of the wave plate 7, the piston 6 reciprocates twice. The reciprocation of the piston 6 causes the refrigerant gas in a suction chamber 10 to enter the bores 1*a* and 2*a* via inlet ports 12 and associated inlet valves 11. The refrigerant gas in the bores 1*a* and 2*a* is exhausted to a discharge chamber 15 via discharge ports 14 and associated discharge valves 13.

The cam surfaces 7*a* and 7*b* have cross sections on a plane containing the axis $L_0$ along an arc, which has the same radius of curvature as the radius of curvature $R_1$ of the second spherical surfaces 8*b* and 9*b*. Therefore, the second spherical surfaces 8*b* and 9*b* of the shoes 8 and 9 have a line contact with the cam surfaces 7*a* and 7*b*. Since the centers $Q_1$ and $Q_2$ of the first spherical surfaces 8*a* and 9*a* are located at the centers of the second spherical surfaces 8*b* and 9*b*, the displacement of the piston 6 accurately reflects the displacement of the cam surfaces 7*a* and 7*b* on the displacement curve F of the cam 7.

Figure 4:
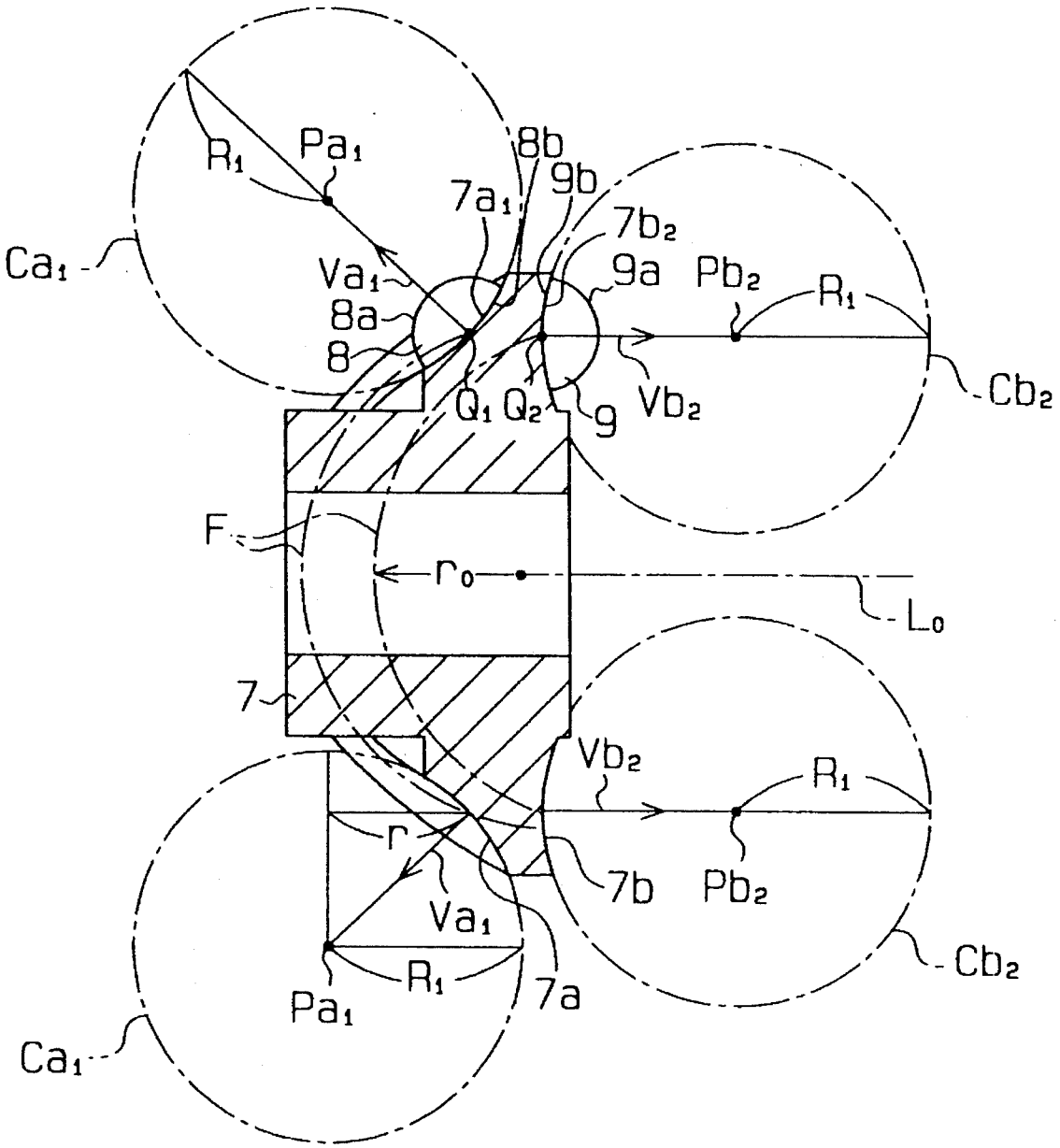
FIG. 4 is a cross-sectional view showing the wave plate turned 90 degrees from the position in FIG. 3.

FIG. 4 illustrates the wave plate 7 turned 90 degrees from the position in FIG. 3. As shown in FIGS. 3 and 4, a pair of rightmost portions $7a_1$ of the front cam surface 7*a* are arranged at an angular distance of 180 degrees from each other. A pair of leftmost portions $7a_2$ are respectively separated from the pair of rightmost portions $7a_1$ by 90 degrees. A leftmost portion $7b_1$ of the rear cam surface 7*b* is located at the back of the leftmost portion $7a_2$ of the front cam surface 7*a*. A rightmost portion $7b_2$ of the rear cam surface 7*b* is located at the rear of the rightmost portion $7a_1$ of the front cam surface 7*a*.

The rightmost portion $7a_1$ of the cam surface 7*a* is used for driving the piston 6 toward the bottom dead center on the side of the bore 1*a*. The leftmost portion $7a_2$ of the cam surface 7*a* is used for driving the piston 6 toward the top dead center on the side of the bore 1*a*. The leftmost portion $7b_1$ of the cam surface 7*b* is used for driving the piston 6 toward the bottom dead center of the piston 6 on the side of the bore 2*a*. The rightmost portion $7b_2$ of the cam surface 7*b* is used for driving the piston 6 toward the top dead center of the piston 6 on the side of the bore 2*a*.

The leftmost portion $7a_2$ (corresponding to the top dead center) of the cam surface 7*a* is located on a circle $Ca_2$ indicated by a chain line in FIG. 3. The leftmost portion $7b_1$ (corresponding to the bottom dead center) of the cam surface 7*b* is located on a circle $Cb_1$ and is also indicated by a chain line in FIG. 3. The rightmost portion $7a_1$ (corresponding to the bottom dead center) of the cam surface 7*a* is located on a circle $Ca_1$ as indicated by a chain line in FIG. 4. The rightmost portion $7b_2$ (corresponding to the top dead center) of the cam surface 7*b* is located on a circle $Cb_2$ and is similarly indicated by a chain line in FIG. 4. The circles $Ca_1$, $Ca_2$, $Cb_1$ and $Cb_2$ have the same radius.

The centers, $Pa_1$ and $Pb_1$, of the circles $Ca_1$ and $Cb_1$ lie outside the axis $L_1$ of the piston 6, and the centers, $Pa_2$ and $Pb_2$, of the circles $Ca_2$ and $Cb_2$ lie on the axis $L_1$ of the piston 6. That is, a normal vector $Va_1$ on the displacement curve F at the rightmost portion $7a_1$ (the bottom-dead-center portion, hereinafter referred to as the BDC portion) of the cam surface 7*a* is inclined outward with respect to the axis $L_0$ of the rotary shaft 3. A normal vector $Va_2$ on the displacement curve F at the leftmost portion $7a_2$ (the top-dead-center portion, hereinafter referred to as the TDC portion) of the cam surface 7*a* is parallel to the axis $L_0$ of the rotary shaft 3. A normal vector $Vb_1$ on the cycle displacement curve F at the leftmost portion $7b_1$ (the BDC portion) of the cam surface 7*b* is inclined outward with respect to the axis $L_0$ of the rotary shaft 3. A normal vector $Vb_2$ on the displacement curve F at the rightmost portion $7b_2$ (the TDC portion) of the cam surface 7*b* is parallel to the axis $L_0$ of the rotary shaft 3.

A normal vector on the displacement curve F of the cam surface 7*a* is gradually inclined outward, with respect to the axis $L_0$ between the TDC portion $7a_2$ and the BDC portion $7a_1$ as the normal vector position is shifted toward the BDC portion $7a_1$ from the TDC portion $7a_2$. Likewise, a normal vector on the displacement curve F of the cam surface 7*b* is gradually inclined outward with respect to the axis $L_0$ between the TDC portion $7b_2$ and the BDC portion $7b_1$ as the vector position is shifted toward the BDC portion $7b_1$ from the TDC portion $7b_2$.

The radius of curvature $R_1$ of the second spherical surfaces 8*b* and 9*b* of the shoes 8 and 9 is restricted by the radius of curvature of the displacement curve F at the BDC portions $7a_1$ and $7b_1$ (indicated by $r_0$ in FIG. 4). If the normal vectors at the BDC portions $7a_1$ and $7b_1$ are parallel to the axis $L_0$, therefore, the radius of curvature $R_1$ should be smaller than the radius of curvature $r_0$ of the displacement curve F at the BDC portions $7a_1$ and $7b_1$.

Since the normal vectors $Va_1$ and $Vb_1$ at the BDC portions $7a_1$ and $7b_1$ are inclined outward with respect to the axis $L_0$ in this embodiment, the radius of curvature $R_1$ can be made greater than the radius of curvature $r_0$. The radius $R_1$ of the BDC portion $7b_1$ is in fact set larger than the radius of curvature $r_0$ as shown in FIG. 3. Given the above conditions, an arc crossing between the circumferential surface $C_0$ and the second spherical surface 9b and having a radius of curvature "r", is smaller than the radius $R_1$. As the inclination of the normal vector $Vb_1$ increases, the radius of curvature "r" becomes smaller than the radius $R_1$.

If the radius of curvature "r" is larger than the radius of curvature $r_0$, the second spherical surface 9b is lifted without contacting the BDC portion $7b_1$. If the radius of curvature "r" is equal to or smaller than the radius of curvature $r_0$, the second spherical surface 9b comes in line contact with the BDC portion $7b_1$. By setting the radius of curvature "r" equal to or smaller than the radius of curvature $r_0$ and as close to this radius of curvature $r_0$ as possible, the radius of curvature $R_1$ of the second spherical surface 9b of the shoe 9 becomes greater than the radius of curvature $r_0$. This would reduce the Hertz's pressure occurring between the second spherical surface 9b and the cam surface 7b.

The radius of curvature of the second spherical surface 8b of the shoe 8 can also be set greater than the radius of curvature $r_0$, thus reducing the Hertz's pressure between the second spherical surface 8b and the cam surface 7a. The reduction in Hertz's pressure improves the pressure resistance characteristics of the shoes 8 and 9 as well as the wave plate 7. This pressure reduction thus improves the durability of the compressor. In this case, the radius of curvature $R_1$ of the second spherical surfaces 8b and 9b can be increased without increasing the diameter of the piston 6 or the diameter of the wave plate 7. It is therefore possible to improve the durability of the compressor without enlarging the compressor.

Figure 5:
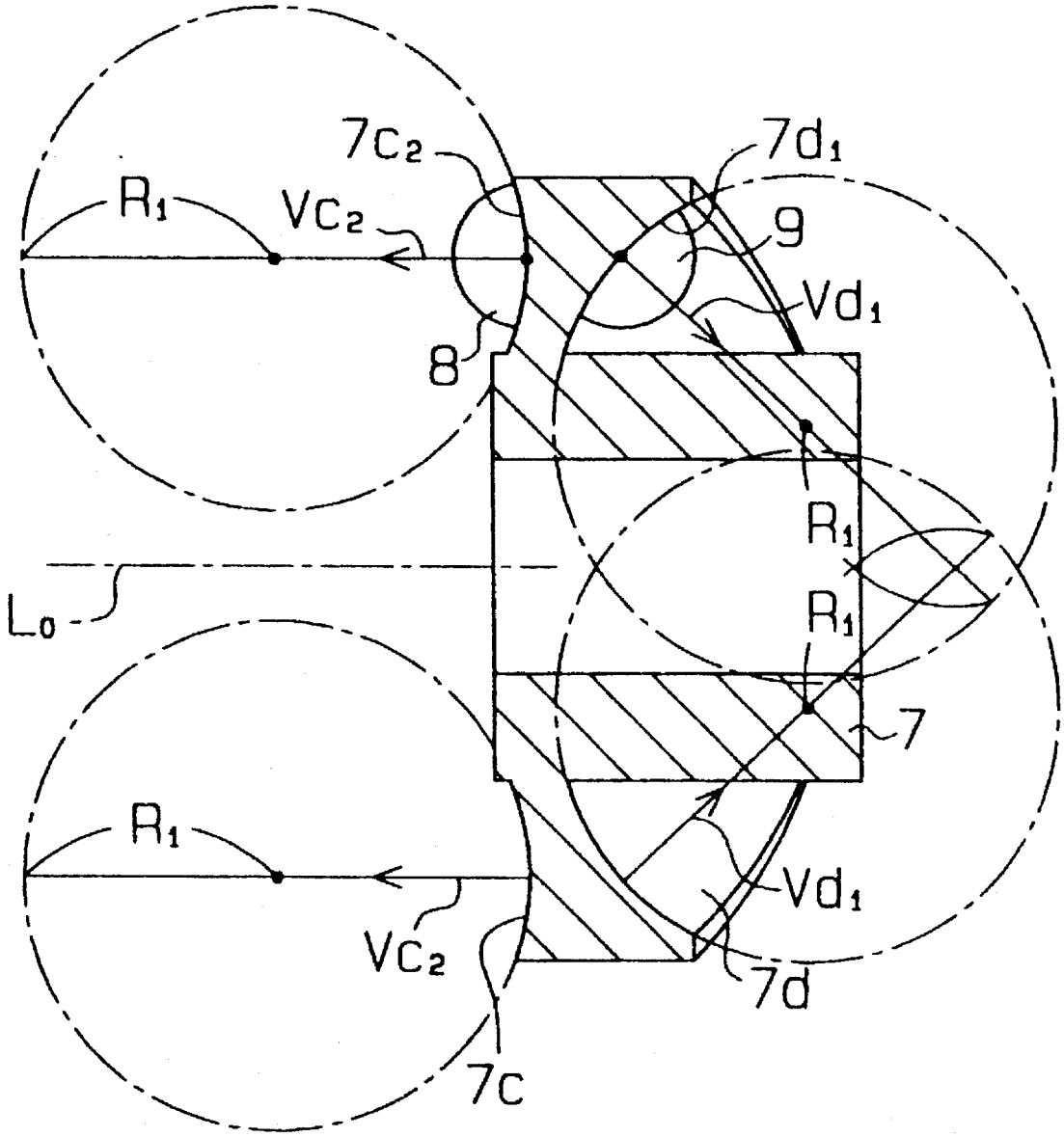
FIG. 5 is a cross section of a wave plate in a modified embodiment.
Figure 6:
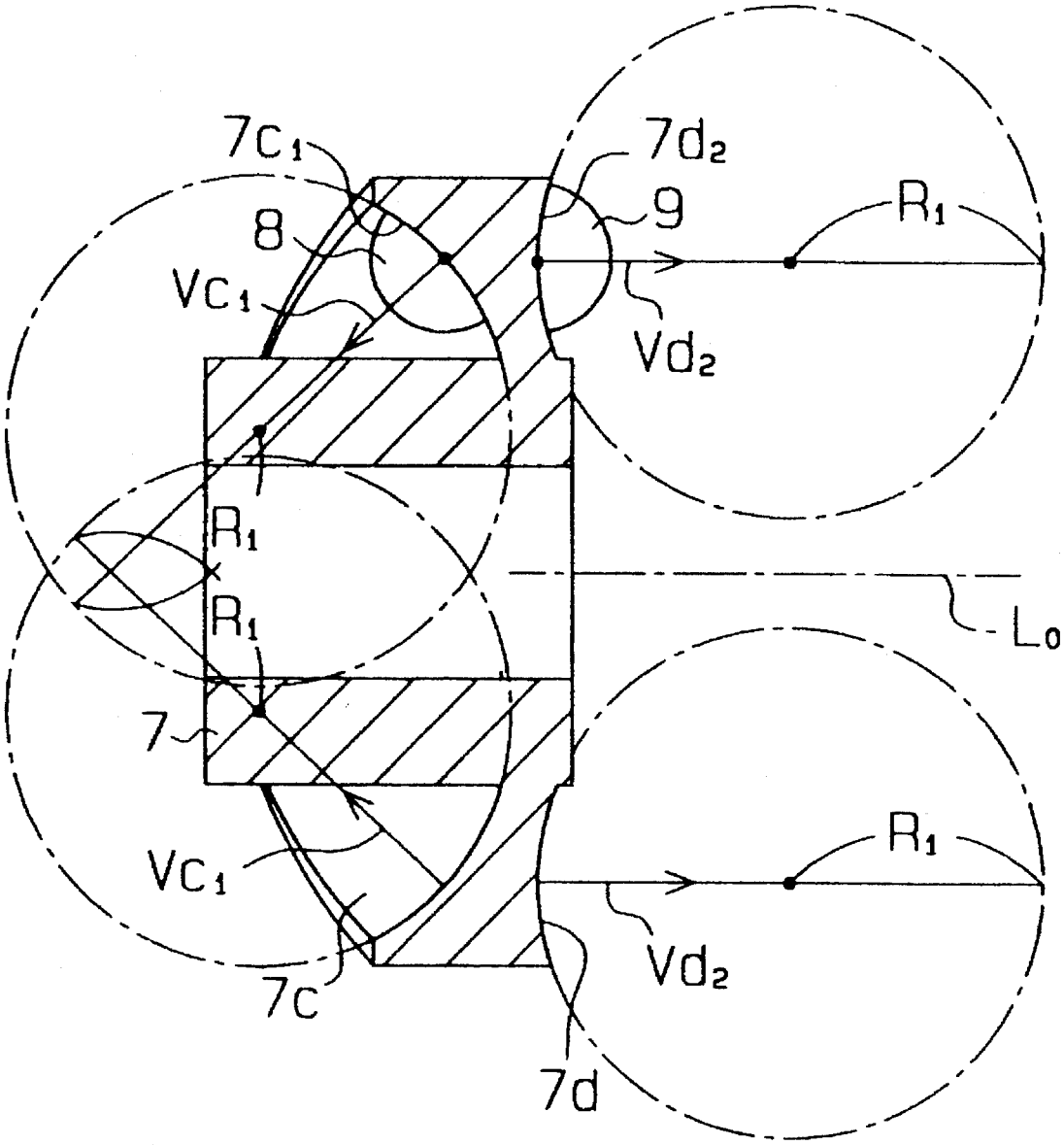
FIG. 6 is a cross-sectional view showing the wave plate turned 90 degrees from the position in FIG. 5.

The present invention is not limited to the above-described embodiment. For example, normal vectors $Vc_1$ and $Vd_1$ at BDC portions $7c_1$ and $7d_1$ of cam surfaces 7c and 7d may be inclined inward with respect to the axis $L_0$ as shown in FIGS. 5 and 6. Normal vectors $Vc_2$ and $Vd_2$ at TDC portions $7c_2$ and $7d_2$ of the cam surfaces 7c and 7d are parallel to the axis $L_0$. FIG. 6 illustrates the wave plate 7 turned 90 degrees from the position in FIG. 5. Even in the case where the normal vectors $Vc_1$ and $Vd_1$ are inclined inward with respect to the axis $L_0$, the radius of curvature $R_1$ of the second spherical surfaces 8b and 9b can be set greater than the radius of curvature $r_0$ of the displacement curve F at the BDC portions $7c_1$ and $7d_1$.

Figure 7:
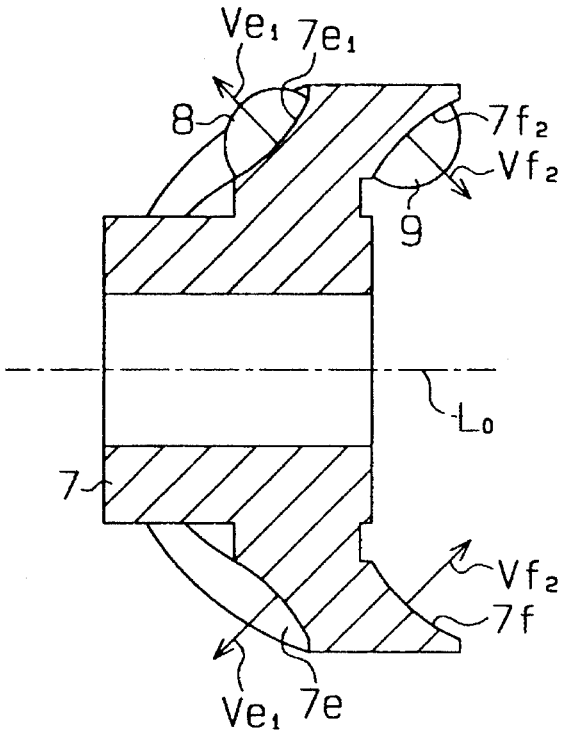
FIG. 7 is a cross section of a further example of the wave plate.
Figure 8:
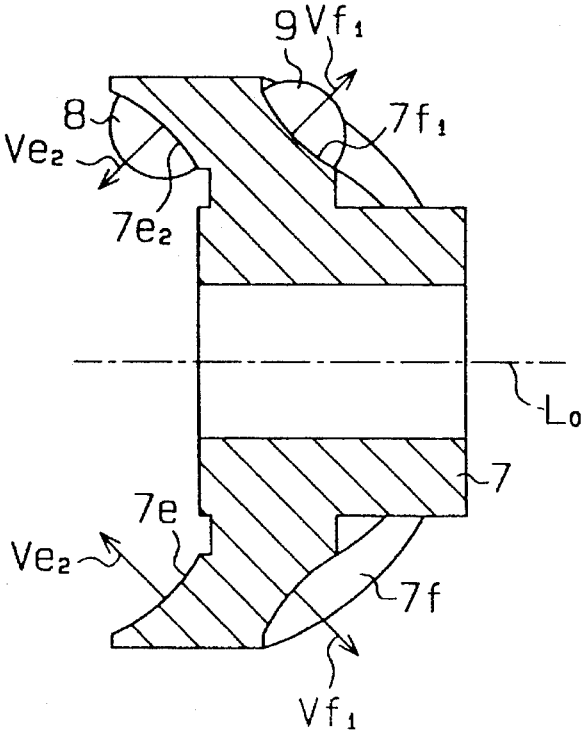
FIG. 8 is a cross-sectional view showing the wave plate turned 90 degrees from the position in FIG. 7.

Further, normal vectors $Vc_1$ and $Vf_1$ at BDC portions 7e1 and $7f_1$ of cam surfaces 7e and 7f may be inclined outward with respect to the axis $L_0$. Normal vectors $Ve_2$ and $Vf_2$ at TDC portions $7e_2$ and $7f_2$ may be inclined inward with respect to the axis $L_0$, as shown in FIGS. 7 and 8. FIG. 8 illustrates the wave plate 7 turned 90 degrees from the position in FIG. 7.

Figure 9:
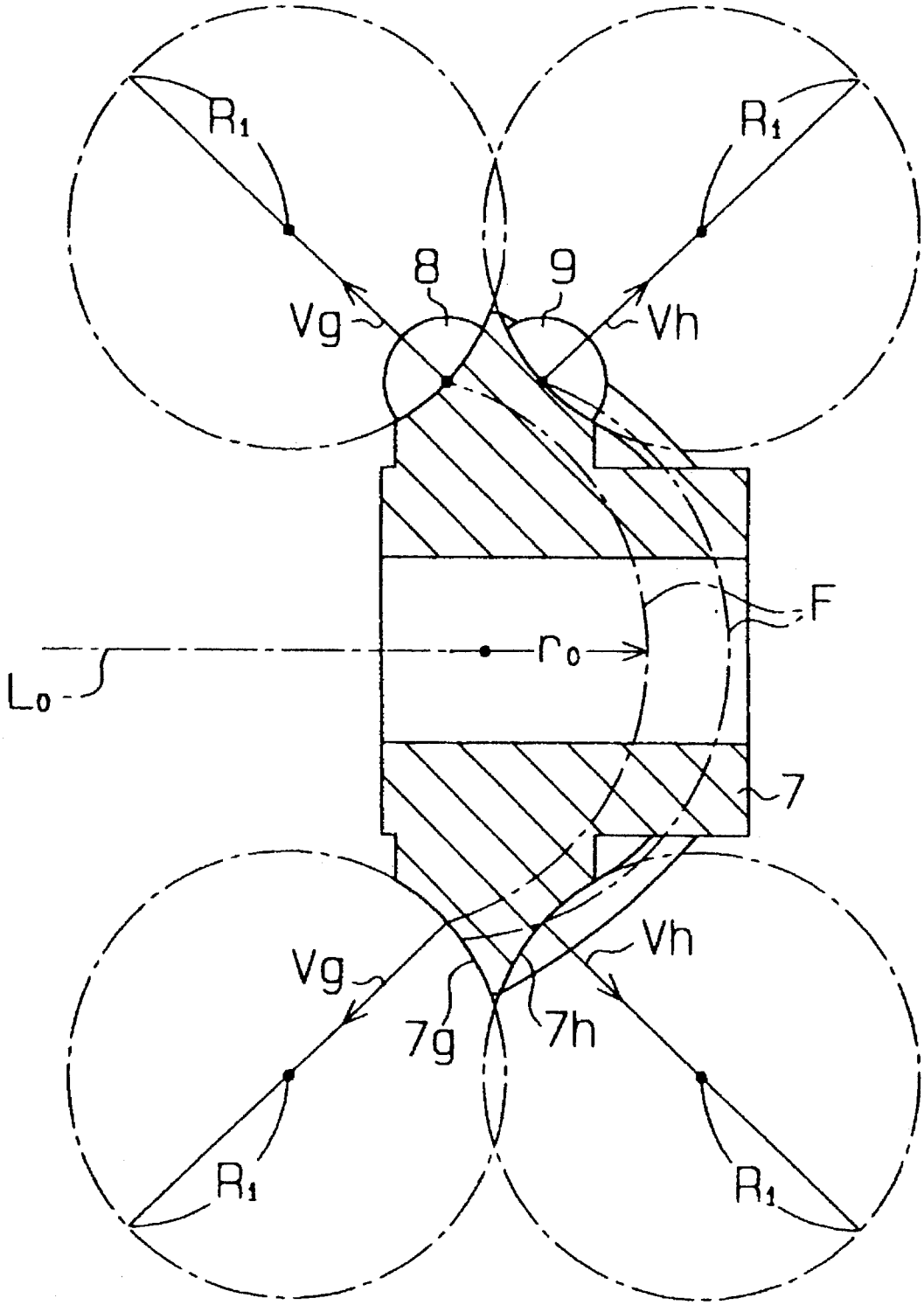
FIG. 9 is a cross section of a still further example of the wave plate.
Figure 10:
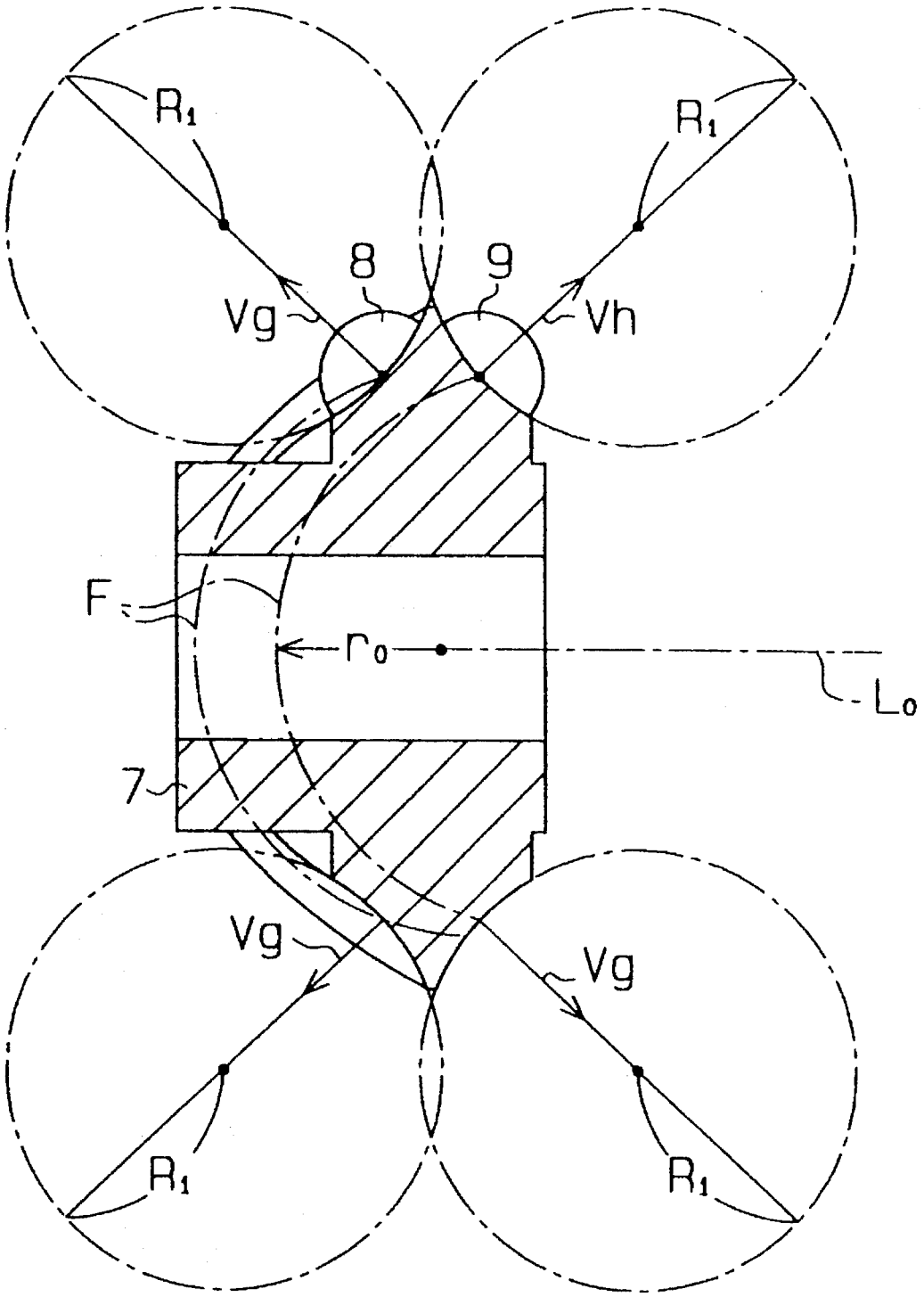
FIG. 10 is a cross-sectional view showing the wave plate turned 90 degrees from the position in FIG. 9.

Furthermore, normal vectors Vg and Vh at all the points on the displacement curve F on cam surfaces 7g and 7h may be inclined outward with respect to the axis $L_0$ of the rotary shaft as shown in FIGS. 9 and 10. FIG. 10 illustrates the wave plate 7 turned 90 degrees from the position in FIG. 9.

Figure 11:
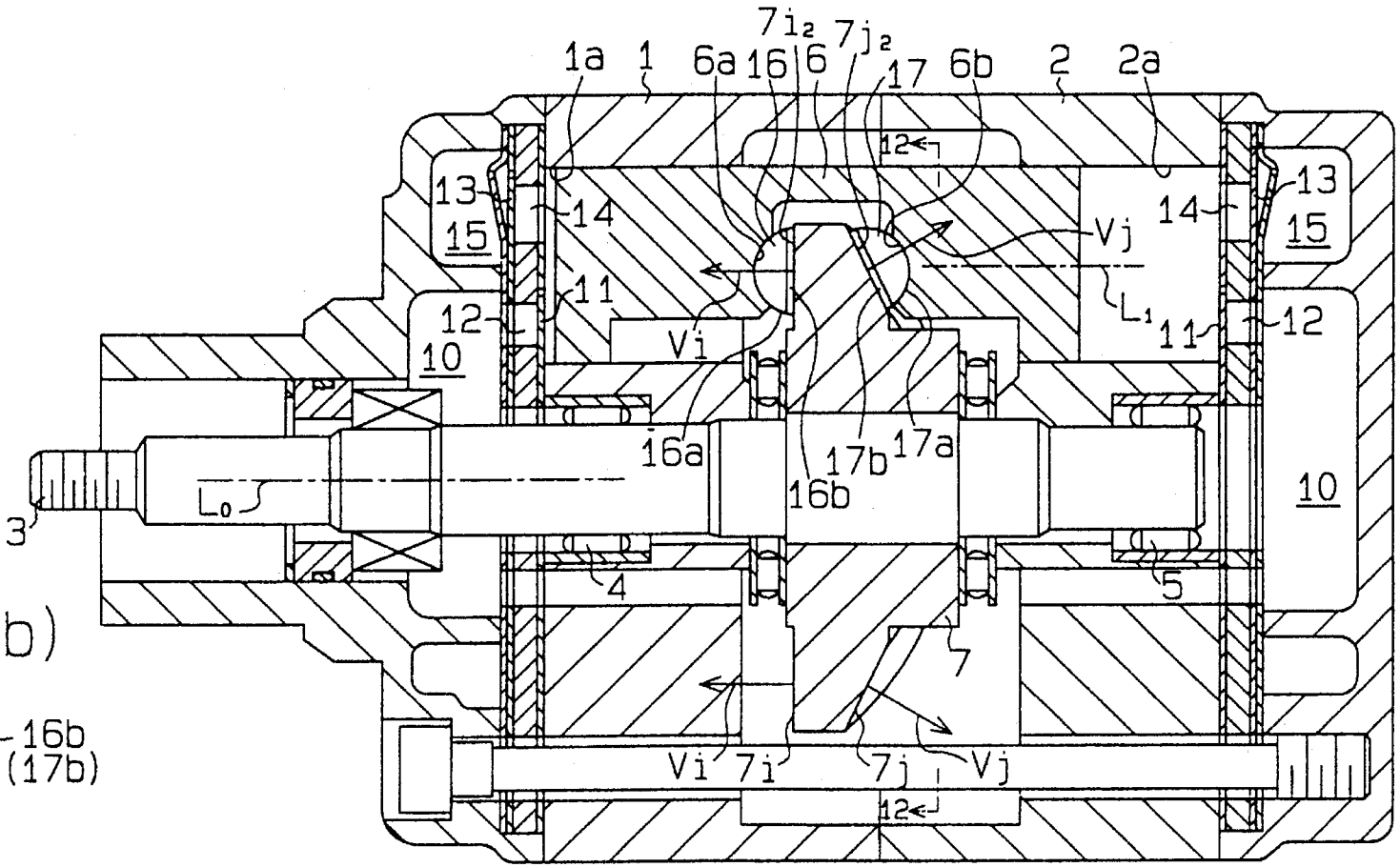
FIG. 11(*a*) is a side cross-sectional view showing an entire compressor according to a modification of the present invention.
Figure 11:
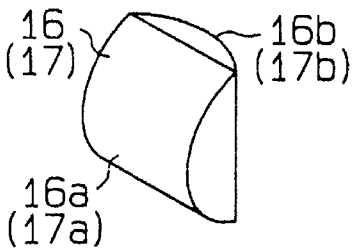
Figure 12:
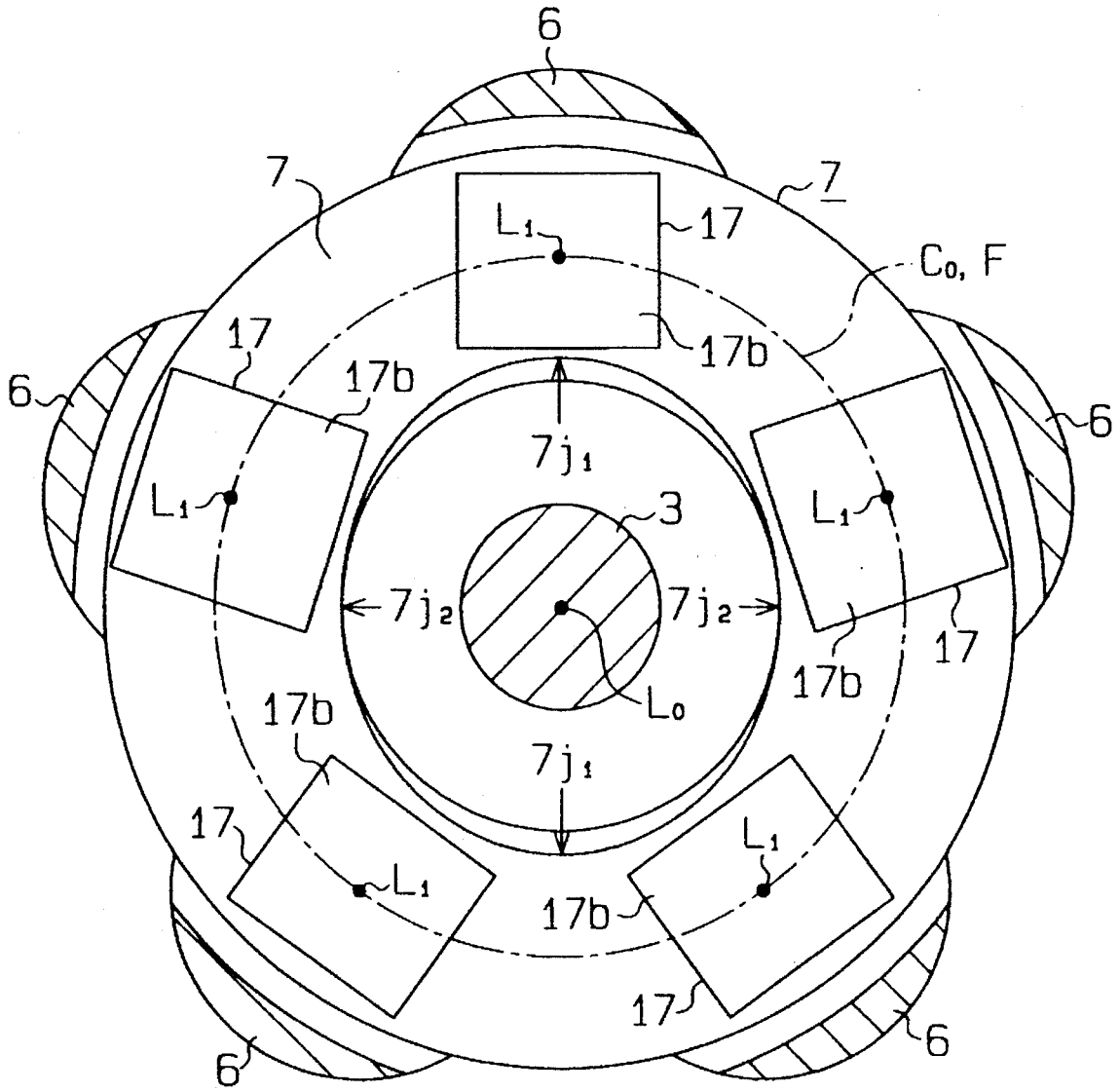
FIG. 12 is a cross-sectional view taken along the line 12—12 in FIG. 11.
Figure 13:
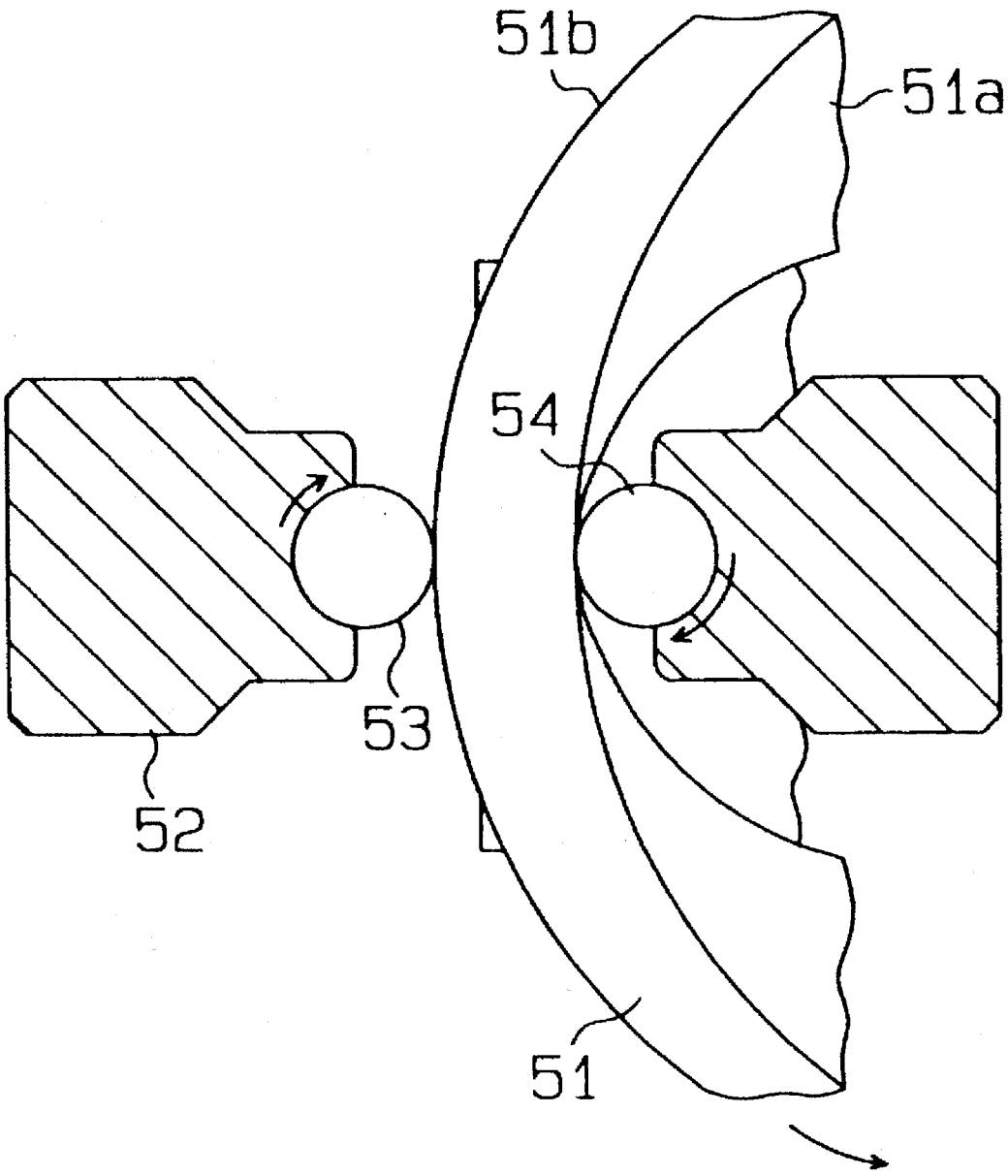
Fig. 13 (Prior Art)
FIG. 13 is a partially cross-sectional view of a conventional wave plate type compressor.

As shown in FIGS. 11(*a*), 11(*b*) and 12, both the first surfaces 16a and 17a of shoes 16 and 17, which are to be fitted in a piston, and the second surfaces 16b and 17b of the shoes, which slide on the wave plate 7, may be designed with a cylindrical shape. In this case, both the cam surfaces 7i and 7j of the wave plate 7 that lie on a plane containing the axis $L_0$ of the rotary shaft, and the second surfaces 16b and 17b that lie on the same plane have respectively cross sections along a straight line. The first surfaces 16a and 17a slide in contact with the cylindrical inner walls of recesses 6a and 6b of the piston 6. The shoes 16 and 17 are rotatable within a plane containing the axis $L_0$ of the wave plate 7.

The second surfaces 16b and 17b are therefore always in line contact with the cam surfaces 7i and 7j, even if the normal vector Vj at the BDC portion $7j_1$ is inclined with respect to the axis $L_0$ of the rotary shaft while the normal vector Vi at the TDC portions $7i_2$ and $7j_2$ are parallel to the axis $L_0$.

The shoes 16 and 17, when cut along a plane perpendicular to the lengthwise direction of the second surfaces 16b and 17b, have semicircular cross sections. If the second surfaces 16b and 17b of the shoes 16 and 17 located at the BDC portion $7j_1$ of the cam surface 7j, are cut at the circumferential surface $C_0$, the cross sections are semi-elliptic. The curvature of this semi-elliptic cross section on the displacement curve F is greater than the curvature of the semicircular cross section. It is therefore possible to set the radius of curvature of the second surfaces 16b and 17b greater than the radius of curvature $r_0$ of the displacement curve F at the BDC portion $7j_1$. This reduces the Hertz's pressure between the shoes 16 and 17 and the cam surfaces 7i and 7j.

The cam surfaces may be formed in a convex shape, and the second surfaces of the shoes, which engage with the cam surfaces, may be formed in a concave shape.

What is claimed is:

1. A wave plate type compressor having a wave plate rotatable about an axis of a rotary shaft and a piston connected to the wave plate, said wave plate causing the piston to reciprocate between a top dead center and a bottom dead center of its stroke in accordance with the rotational movement of the wave plate, said compressor comprising:

cam means provided on the wave plate for actuating the piston, said cam means having first portions for driving the piston toward said top dead center, and second portions for driving the piston toward said bottom dead center, said first and second portions being disposed alternately circumferentially about said wave plate, there being a plurality of said first and second portions for causing said piston to reciprocate a plurality of times for each revolution of said wave plate;

transmission means interposed between the piston and the cam means for transmitting the rotational movement of the wave plate to the piston, said transmission means slidably contacting the cam means;

said first and second portions causing the transmission means to follow along the cam means; and at least one of said first and second portions of said cam means having a surface directed so that a line normal to said surface, at a midpoint of said surface in the radial direction of said wave plate, extends obliquely to the axis of the rotary shaft for ensuring constant contact between said transmission means and said one of the portions.

2. A compressor according to claim 1, wherein said first portions of said cam each have a surface directed so that a line normal to said surface, at a midpoint of said surface in the radial direction of said wave plate, extends in parallel with the axis of the rotary shaft.

3. A compressor according to claim 2, wherein said second portions of said cam each have a surface directed so that a line normal to said surface, at a midpoint of said surface in the radial direction of said wave plate, extends obliquely outward to the axis of the rotary shaft.

4. A compressor according to claim 1, wherein said cam means has a pair of the first portions and a pair of the second portions, and wherein said first and second portions are arranged at equiangular distances.

5. A compressor according to claim 1, wherein said cam means has a cross section extending along a line on a plane containing the axis of the rotary shaft.

6. A compressor according to claim 5, wherein said first portions of said cam each have a surface directed so that a line normal to said surface, at a midpoint of said surface in the radial direction of said wave plate, extends in parallel with the axis of the rotary shaft.

7. A compressor according to claim 6, wherein said second portions of said cam each have a surface directed so that a line normal to said surface, at a midpoint of said surface in the radial direction of said wave plate, extends obliquely outward to the axis of the rotary shaft.

8. A compressor according to claim 1, wherein said cam means has a recessed arcuate cross section and said piston has a recess with a cross section in a spherical shape, and wherein said transmission means has a substantially semi-spherical shape and has a spherical first surface slidable in said recess of said piston and a spherical second surface slidable on said cam means.

9. A compressor according to claim 8, wherein said second surface has a midpoint, and said first surface has a center of revolution substantially coincident with said mid-point of said second surface.

10. A compressor according to claim 8, wherein said spherical second surface of said transmission means has a radius of curvature, and said cam surface has a radius of curvature in a plane containing the axis of the rotary shaft, and said cam surface radius of curvature is substantially the same as said radius of curvature of the second surface of the transmission means.

11. A compressor according to claim 8, wherein said spherical second surface of said transmission means has a radius of curvature, and said first surface has a radius of curvature greater than said radius of curvature of said second surface.

12. A compressor according to claim 8, wherein said cam means has cam surfaces on both sides of said wave plate, said piston has a body with a pair of heads at both ends of said body and a pair of recesses at a center portion of said body, and said transmission means is provided between each of said recesses and the respective cam surface on each side of said wave plate.

13. A compressor according to claim 1 further comprising a cylinder block for accommodating said plate at a center portion, said cylinder block having a plurality of cylinder bores extending parallel to the axis of the rotary shaft.

14. A wave plate type compressor having a wave plate rotatable about an axis of a rotary shaft and a plurality of double-headed pistons connected to the wave plate, wherein the wave plate causes the pistons to reciprocate between a top dead center and a bottom dead center of its stroke in accordance with the rotational movement of the wave plate, said compressor comprising:

a pair of cam surfaces provided on both sides of said wave plate for actuating the pistons, each cam surface having a recessed arcuate cross section, a pair of first portions of said wave plate for driving the pistons toward said top dead center and a pair of second portions of said wave plate for driving the pistons toward said bottom dead center;

a plurality of transmission members respectively interposed between each piston and each of said pair of cam surfaces for transmitting the rotational movement of the wave plate to the piston;

said first and second portions of said wave plate causing the transmission members to follow along the cam surfaces, said transmission members being substantially semispherical and having a spherical first surface slidable on its associated cam surface and a spherical second surface slidable in a recess of an associated one of said pistons; and wherein at least one pair of said pairs of first and second portions of said wave plate each have a surface directed so that a line normal to said surface, at a midpoint of said surface in the radial direction of said wave plate, extends obliquely to the axis of the rotary shaft for ensuring constant contact between said transmission members and said one pair of the portions.

15. A compressor according to claim 14, wherein said first portions of said wave plate each have a surface directed so that a line normal to said surface, at a midpoint of said surface in the radial direction of said wave plate, extends in parallel with the axis of the rotary shaft.

16. A compressor according to claim 15, wherein said second portions of said cam each have a surface directed so that a line normal to said surface, at a midpoint of said surface in the radial direction of said wave plate, extends obliquely outward to the axis of the rotary shaft.

* * * * *